US009523192B2

(12) United States Patent
Kim et al.

(10) Patent No.: US 9,523,192 B2
(45) Date of Patent: Dec. 20, 2016

(54) SOUND-ABSORBING MATERIAL WITH EXCELLENT SOUND-ABSORBING PERFORMANCE AND METHOD FOR MANUFACTURING THEREOF

(71) Applicants: Hyundai Motor Company, Seoul (KR); Kia Motors Corporation, Seoul (KR); Toray Chemical Korea Inc., Gumi, Geongsangbuk-Do (KR)

(72) Inventors: Hyo Seok Kim, Gyeonggi-Do (KR); Do Hyun Kim, Gyeonggi-Do (KR); Chi Hun Kim, Gyeonggi-Do (KR); Kie Youn Jeong, Gyeonggi-Do (KR); Bong Hyun Park, Gyeonggi-Do (KR); Jung Wook Lee, Gyeonggi-Do (KR)

(73) Assignees: Hyundai Motor Company, Seoul (KR); Kia Motors Corporation, Seoul (KR); Toray Chemical Korea Inc., Gumi, Geongsangbuk-do (KR)

( * ) Notice: Subject to any disclaimer, the term of this patent is extended or adjusted under 35 U.S.C. 154(b) by 0 days.

(21) Appl. No.: 14/673,849

(22) Filed: Mar. 30, 2015

(65) Prior Publication Data

US 2015/0204066 A1 Jul. 23, 2015

Related U.S. Application Data

(63) Continuation of application No. PCT/KR2013/008630, filed on Sep. 26, 2013.

(30) Foreign Application Priority Data

Sep. 28, 2012 (KR) ..... 10-2012-0108764

(51) Int. Cl.

| | |
|---|---|
| ***E04B 1/86*** | (2006.01) |
| ***E04B 1/84*** | (2006.01) |
| ***D04H 1/4391*** | (2012.01) |
| ***D04H 1/542*** | (2012.01) |
| ***G10K 11/162*** | (2006.01) |
| ***D04H 1/541*** | (2012.01) |

(52) U.S. Cl.
CPC ..... *E04B 1/84* (2013.01); *D04H 1/4391* (2013.01); *D04H 1/541* (2013.01); *D04H 1/542* (2013.01); *G10K 11/162* (2013.01)

(58) Field of Classification Search
CPC ..... E04B 1/86
(Continued)

(56) References Cited

U.S. PATENT DOCUMENTS 4,764,426 A * 8/1988 Nakamura ..... D01F 1/10 428/364
2001/0008673 A1 7/2001 Nagata et al.
(Continued)

FOREIGN PATENT DOCUMENTS

CN 1764941 A 4/2006
CN 1809871 A 7/2006
(Continued)

OTHER PUBLICATIONS

International Search Report—PCT/ISA/210 in International Application No. PCT/KR/2013/008630.

*Primary Examiner* — Forrest M Phillips
(74) *Attorney, Agent, or Firm* — Mintz Levin Cohn Ferris Glovsky and Popeo, P.C.; Peter F. Corless

(57) ABSTRACT

Disclosed are a sound-absorbing material with improved sound-absorbing performance and a method for manufacturing the sound-absorbing material. The sound-absorbing material may improve sound absorption coefficient and transmission loss by forming large surface area and air layer, so as to induce viscosity loss of incident sound energy, and may provide light-weight design of a sound absorbing part or material since sound-absorbing performance may be substantially improved using reduced amount of fiber. Further, the sound-absorbing material may improve sound-absorbing performance by using binder fiber having rebound resilience, so as to maintain enough strength between fibers
(Continued)

and also to maximize viscosity loss of sound energy transmitted to fiber structure.

21 Claims, 4 Drawing Sheets

(58) Field of Classification Search
USPC ..... 181/294
See application file for complete search history.

(56) References Cited

U.S. PATENT DOCUMENTS

2001/0050196 A1 12/2001 Okada et al.
2004/0048036 A1* 3/2004 Nakasuji ..... B32B 5/26 428/95
2006/0260870 A1* 11/2006 Nakagawa ..... E01F 8/0082 181/295
2009/0246492 A1 10/2009 Bishop et al.
2013/0133980 A1* 5/2013 Pourdeyhimi ..... D01F 6/00 181/294
2014/0342629 A1* 11/2014 Nakatsuka ..... D01F 8/16 442/181
2015/0345055 A1* 12/2015 Dei ..... D01F 1/08 442/50

FOREIGN PATENT DOCUMENTS

JP 2005-141238 6/2005
KR 10-2003-0000746 1/2003
KR 10-2011-0034522 4/2011
KR 10-1289129 B1 7/2013
WO 2004/107314 12/2004

* cited by examiner

SOUND-ABSORBING MATERIAL WITH EXCELLENT SOUND-ABSORBING PERFORMANCE AND METHOD FOR MANUFACTURING THEREOF

CROSS-REFERENCE TO RELATED APPLICATION

This application is a continuation of international Patent Application No. PCT/KR13/008630 filed Sep. 26, 2013, which claims the benefit of Korean Patent Application No. 10-2012-0108764 filed on Sep. 28, 2012, the entire contents of both applications are incorporated herein by reference.

TECHNICAL FIELD

The present invention relates to a sound-absorbing material with improved sound-absorbing performance and a method for manufacturing the same. In particular, the sound-absorbing material with improved sound-absorbing performance may be used for blocking inflow of external noise into vehicle interior by being attached as vehicle components or interior and exterior materials of a vehicle body, and may be used in electric devices and the like that use motor parts so as to improve noise insulation performance thereof.

BACKGROUND

In general, noise introduced into a vehicle may be classified into a noise generated at an engine and introduced through a vehicle body and a noise generated when tires are contacted with a road surface and introduced through a vehicle body. There may be two ways to block theses noises such as improving sound-absorbing performance and improving noise insulation performance. Sound-absorbing means that generated sound energy is converted into thermal energy and then dissipated while it is transmitted through internal route of a material, and noise insulation means that generated sound energy is reflected and blocked by a shelter.

According to such characteristics of sound, in order to improve Noise, Vibration & Harshness (NVH) of a vehicle in general, a heavier and thicker sound-absorbing material has been mainly used in luxury cars. However, when such sound-absorbing material is used, noise may be reduced, but there is a problem of deteriorating fuel efficiency by increasing vehicle weight.

Further, in order to overcome problems of the conventional sound-absorbing material, a method in which porosity of the material is improved by thinning fiber thickness have been developed thereby improving sound-absorbing performance and also reducing weight of fiber aggregate. However, this method may also have a weakness such that needs surface density of the fiber aggregate may be improved in order to improve the desired NVH performance.

Further, in order to manufacture non-woven type fiber aggregate, staple fiber and binder fiber are mixed together at a proper ratio. As the binder fiber, in general, staple fiber manufactured by conjugate-spinning regular polyester is used for an inner layer and low melting polyester is used for an outer layer.

However, when using this conventional binder fiber with the low melting polyester, the fiber aggregate is hardened, and thus there may be a problem that vibration generated by sound wave propagation and transmitted to matrix structure is not fully attenuated, thereby reducing sound absorbtion coefficient mainly at low frequency region.

The matters described as the related art have been provided only for assisting in the understanding for the background of the present invention and should not be considered as corresponding to the related art known to those skilled in the art.

SUMMARY OF THE INVENTION

The present invention has been made in an effort to solve the above-described problems associated with prior art.

In preferred aspects, the present invention provides a sound-absorbing material and a method of manufacturing the same. The sound absorbing material may improve sound absorption coefficient and transmission loss by forming large surface area and air layer, so as to maximize viscosity loss and dissipation route of incident sound energy. As such, the present invention may provide a light-weight design of a sound absorbing part or material because the sound absorbing material may improve sound-absorbing performance by using reduced amount of fiber.

Further, the present invention provides a sound-absorbing material, which may improve formability as well as maintain enough strength between fibers, and may have improved rebound resilience, thereby ultimately having excellent vibration attenuation capability against sound energy transmitted inside matrix.

In one aspect, the present invention provides a method of manufacturing the sound absorbing material as described herein.

In an exemplary embodiment, the present invention provides a method for manufacturing a sound-absorbing material that may comprise: forming fiber aggregate in a nonwoven fabric form. In particular, the fiber aggregate may comprise: a non-circular shaped fiber satisfying the following Formula 1; and a binder fiber that may partly bind at least a portion of the non-circular shaped fiber.

$$1.5 \leq \frac{P}{\sqrt{4 \times \pi \times A}} \qquad \text{Formula 1}$$

As used herein, A refers to a fiber cross sectional area ($\mu m^2$), P refers to a circumference length of fiber cross section ($\mu m$).

The term "partly bind", as used herein, may be understood as "bind at least a portion of a fiber". For instance, the binder fiber may partly bind the non-circular shaped fiber at a portion of the non-circular shaped fiber surface.

In an exemplary embodiment, still provided is a method for manufacturing a sound-absorbing material that may comprise: forming fiber aggregate in a nonwoven fabric form. In particular, the fiber aggregate may comprise: a non-circular shaped fiber satisfying the Formula 1 as described above; and a binder fiber that may bind the non-circular shaped fiber.

The sound-absorbing material may be manufactured by using the non-circular shaped fiber satisfying the value of the Formula 1 of about 2.6 or greater. In particular, the sound-absorbing material may be manufactured by using the non-circular shaped fiber satisfying the value of the Formula 1 of about 3.0 or greater.

The non-circular shaped fiber may have a cross sectional shape that is at least one selected from the group consisting of six-pointed star shape, 3-bar flat type, 6 leaf type, 8 leaf type and wave type. For example, the term "wave type non-circular shaped fiber", as used in the present invention, refers to fiber that may have cross section shape in wave form, and for example, its shape is illustrated in FIG. 5.

Moreover, the non-circular shaped fiber may be of about 35 to 65 mm in length.

The binder fiber may comprise a low melting (LM) elastomer having elastic recovery modulus of about 50 to 80%, and rebound resilience rate of the sound-absorbing material may be about 50 to 80%.

As used herein, the term "low melting (LM)" elastomer material means to have a melting point or melting temperature thereof lower than that of regular or unmodified elastomer material. For instance, the low melting elastomer material as described herein may have a melting point in a range of about 120~170° C.

Further, the binder fiber may be conjugated fiber which may be conjugate-spun by using the LM elastomer as one component.

The term "conjugate-spun" may refer to a spinning method for obtaining desired sectional shape and form of a fiber in which resin materials having different properties are input into two melt-extruders, melt and melt-bonded.

The LM elastomer may be at least one selected from the group consisting of a polyester-based polymer, a polyamide-based polymer, a polystyrene-based polymer, a polyvinyl-chloride-based polymer and a polyurethane-based polymer.

The LM elastomer may be manufactured by esterification and polymerization steps using dimethyl terephthalate (DMT) and dimethyl isophthalate (DMI) or terephthalic acid (TPA) and isophthalic acid (IPA) as an diacid ingredient, and 1,4-butanediol (1,4-BD) and polytetramethyleneglycol (PTMG) as a diol ingredient.

The sound-absorbing material may be manufactured by using the non-circular shaped fiber of about 50 to 80 wt % based on the total weight of the sound-absorbing material and the binder fiber of elastomer 20 to 50 wt %, based on the total weight of the sound-absorbing material.

In another aspect, the present invention provides a sound-absorbing material, which may comprise: a non-circular shaped fiber satisfying the following Formula 1; and binder fiber which may partly bind at least a portion of the non-circular shaped fiber. Alternatively, the binder fiber may bind the non-circular shaped fiber or portions of a plurality of the non-circular shaped fibers.

$$1.5 \leq \frac{P}{\sqrt{4 \times \pi \times A}} \qquad \text{Formula 1}$$

In Formula 1, A refers to a fiber cross sectional area ($\mu m^2$), and P refers to a circumference length of fiber cross section ($\mu m$).

The non-circular shaped fiber may satisfy the value of the Formula 1 of about 2.6 or greater.

The cross sectional shape of the non-circular shaped fiber may be at least one selected from the group consisting of six-pointed star shape, 3-bar flat type, 6-leaf type, 8-leaf type and wave type.

The non-circular shaped fiber may be about 35 to 65 mm in length.

The non-circular shaped fiber may be about 1.0 to 7.0 De in fineness.

The binder fiber may comprise a LM elastomer having elastic recovery modulus of about 50 to 80%, and rebound resilience rate of the sound-absorbing material may be about 50 to 80%.

The binder fiber may be conjugated fiber which may be conjugate-spun by using the LM elastomer as one component.

The LM elastomer may be at least one selected from the group consisting of a polyester-based polymer, a polyamide-based polymer, a polystyrene-based polymer, a polyvinyl-chloride-based polymer and a polyurethane-based polymer.

Further, the sound-absorbing material may comprise the non-circular shaped fiber of about 50 to 80 wt % based on the total weight of the sound-absorbing material and the binder fiber of elastomer 20 to 50 wt % based on the total weight of the sound-absorbing material.

The non-circular shaped fiber may satisfy the value of the Formula 1 of about 3.0 or greater.

The sound-absorbing material of the present invention can improves sound absorption coefficient and transmission loss by forming substantially increased surface area and air layer, so as to induce viscosity loss of incident sound energy. Further, the present invention may provide light-weight design of the sound proofing material or parts since sound-absorbing performance may be improved by using reduced amount of fibers. The sound absorbing material may also improve sound-absorbing performance by using binder fiber having rebound resilience, so as to maintain enough bonding strength between fibers and also to maximize viscosity loss of sound energy transmitted to fiber structure.

Accordingly, a sound-absorbing material may be used for improving noise insulation performance of electric devices and the like using motor parts as well as used through transport such as vehicle, train, ship, aircraft and the like, and a method for manufacturing thereof can be provided.

Further provides is a vehicle that comprises the sound absorbing material as described therein.

Other aspects of the invention are disclosed infra.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
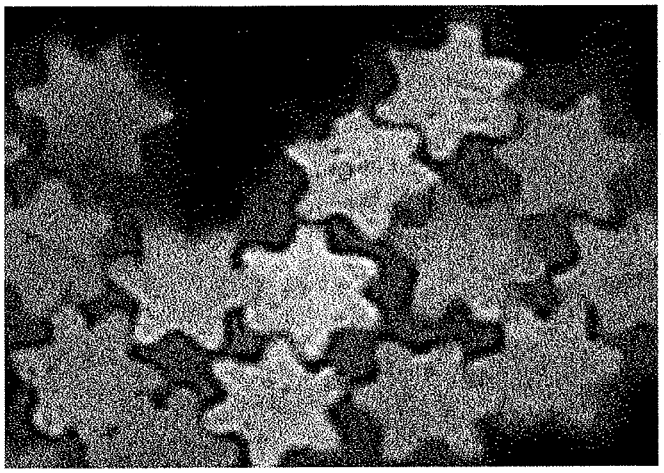
FIG. 1 shows an exemplary six-pointed star shaped non-circular shaped fiber, which may be included in an exemplary sound-absorbing material according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

As described above, since in a conventional sound-absorbing material for a fiber structure, surface density and thickness of fiber aggregate are increased in order to improve sound-absorbing performance and noise insulation performance by increasing porosity and sound wave dissipation route, the vehicle using the conventional sound-absorbing material may increase weight thereby deteriorating fuel efficiency. Further, when low melting polyester binder fiber is used for the conventional sound-absorbing material for a fiber structure, the fiber aggregate may be hardened. Thus, there was a problem that sound absorption coefficient of low frequency is reduced since vibration generated by sound wave propagation and transmitted to matrix structure is not fully attenuated.

Accordingly, the present invention provides a sound-absorbing material which comprises: non-circular shaped fiber satisfying the following Formula 1; and binder fiber that may partly bind at least a portion of the non-circular shaped fiber, to find solutions for the above described problems. Alternatively, the binder fiber may bind the non-circular shaped fiber.

$$1.5 \leq \frac{P}{\sqrt{4 \times \pi \times A}} \qquad \text{Formula 1}$$

As used herein, A refers to a fiber cross sectional area ($\mu m^2$), P refers to a circumference length of fiber cross section ($\mu m$).

As such, sound absorption coefficient and transmission loss may be improved by forming large surface area and air layer, so as to induce viscosity loss of incident sound energy. Further, light-weight design of sounds absorbing parts or materials may be obtained because sound-absorbing performance may be substantially improved although reduced amount of fiber is used, and further, sound-absorbing performance may be improved by using binder fiber having rebound resilience, so as to maintain enough binding strength between fibers and also to maximize viscosity loss of sound energy transmitted to a fiber structure. Thus, a sound-absorbing material having improved sound-absorbing performance may be used for improving noise insulation performance of electric devices and the like using motor parts as well as used through transport such as vehicle, train, ship, aircraft and the like.

In general, when sound wave conflicts with a certain material, it may cause viscosity loss, thereby causing noise reduction while mechanical energy of the sound wave is converted to thermal energy. In order to reduce noise by increasing energy loss rate against sound wave introduced to the fiber aggregate with the same weight, it is advantageous to increase surface area of fiber where viscosity loss of sound wave occurs.

The non-circular shaped fiber satisfy the $\eta$ value of about 1.5 or greater, calculated as $$\eta = \frac{P}{\sqrt{4 \times \pi \times A}}$$

wherein A refers to a Fiber cross sectional area ($\mu m^2$) and P refers to a Circumference length of fiber cross section ($\mu m$). When a greater surface area is provided in a fiber structure of the sound absorbing material than the fiber in the conventional sound-absorbing material, sound absorption coefficient and transmission loss may be improved. When the $\eta$ value is less than about 1.5, the fiber surface area may not be sufficient and the light-weight design thereof may not be obtained because a large amount of fiber needs to effectively embody sound-absorbing performance. The higher $\eta$ value means the greater fiber surface area. Accordingly, the non-circular shaped fiber used in the present invention may have the $\eta$ value of about 2.6 or greater, or particularly the value may be of about 3.0 to 7.0. If the $\eta$ value of the non-circular shaped fiber used in the present invention is greater than about 7.0, production cost may be increased due to increase of nozzle production cost, facilities replacement related to cooling efficiency improvement, polymer modification for solidification rate improvement, productivity reduction and the like.

Figure 5:
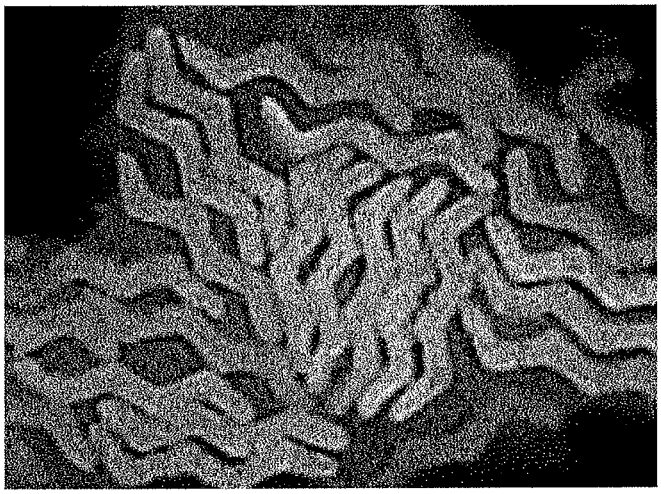
FIG. 5 shows an exemplary wave type non-circular shaped fiber, which may be included in an exemplary sound-absorbing material according to an exemplary embodiment of the present invention.

The non-circular shaped fiber of the present invention, which satisfies the η value of about 1.5 or greater, the cross sectional shape of the non-circular shaped fiber may be a six-pointed star shape, 3-bar flat type, 6-leaf type, 8-leaf type or wave type, or a combination thereof. In the case of the wave type, if the n value satisfies about 1.5 or greater, particular shape such as the number of the curved point in the wave shape, length and width of the cross section and the like may vary. The number of the curved point in the wave shape means the point where the direction is changed to the length direction of the cross section, and for example, the number of the curved point of the wave type non-circular shaped fiber in FIG. 5 is 4.

Figure 2:
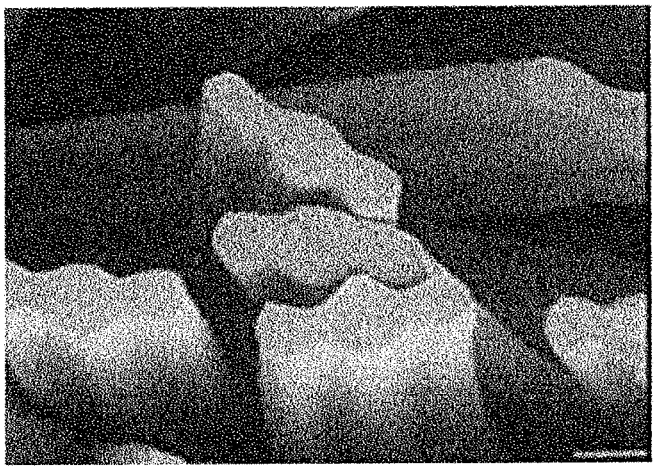
FIG. 2 shows an exemplary 3-bar flat type non-circular shaped fiber, which may be included in an exemplary sound-absorbing material according to an exemplary embodiment of the present invention.
Figure 3:
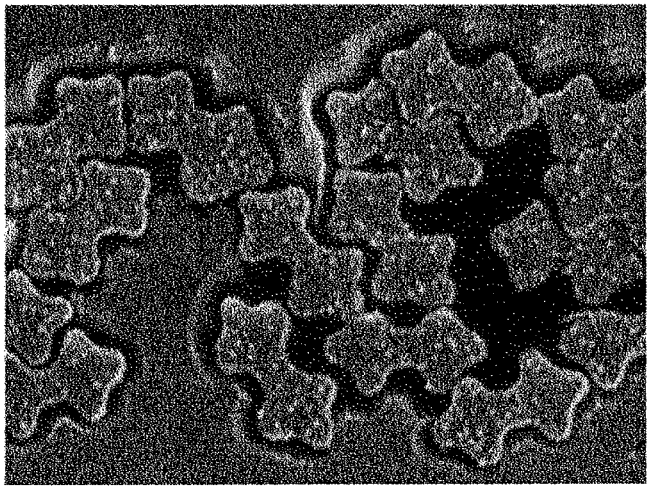
FIG. 3 shows an exemplary 6-leaf type non-circular shaped fiber, which may be included in an exemplary sound-absorbing material according to an exemplary embodiment of the present invention.
Figure 4:
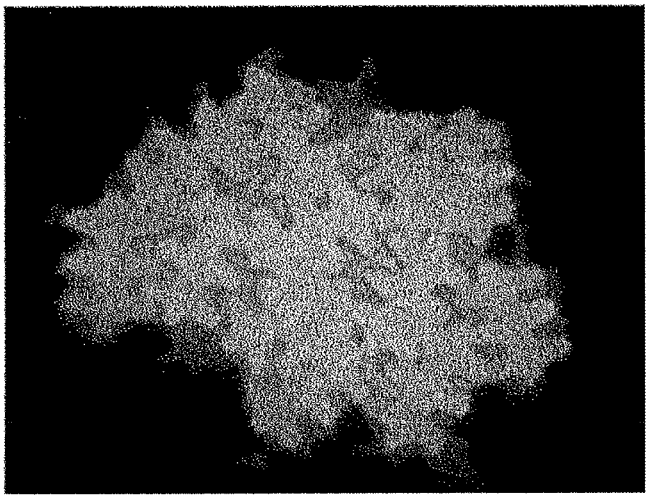
FIG. 4 shows an exemplary 8-leaf type non-circular shaped fiber, which may be included in an exemplary sound-absorbing material according to an exemplary embodiment of the present invention.
Figure 6:
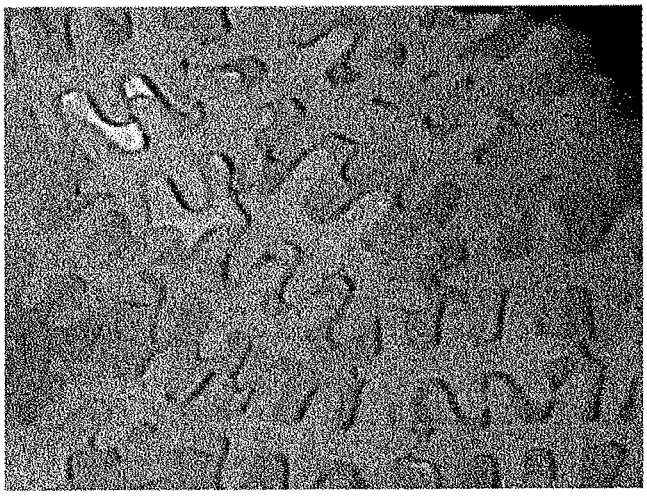
FIG. 6 shows an exemplary 8-leaf type non-circular shaped fiber, which may be included in an exemplary sound-absorbing material according to an exemplary embodiment of the present invention.
Figure 7:
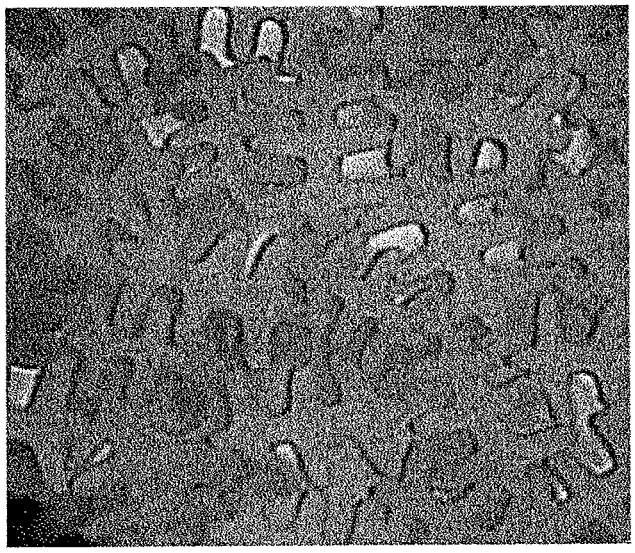
FIG. 7 shows an exemplary 8-leaf type non-circular shaped fiber, which may be included in an exemplary sound-absorbing material according to an exemplary embodiment of the present invention.

For example, FIG. 1 shows an exemplary six-pointed star shape non-circular shaped fiber according to an exemplary embodiment of the present invention, and its η value may be of about 1.51, and FIG. 2 shows an exemplary 3-bar flat type non-circular shaped fiber according to an exemplary embodiment of the present invention, and its η value may be of about 1.60. Further, FIG. 3 shows an exemplary 6-leaf type non-circular shaped fiber according to an exemplary embodiment of the present invention, and its η value may be of about 1.93, FIG. 4 shows an exemplary 8-leaf type non-circular shaped fiber according to an exemplary embodiment of the present invention, and its η value may be of about 2.50, FIG. 5 shows an exemplary wave type non-circular shaped fiber according to an exemplary embodiment of the present invention, and its η value may be of about 2.55, FIG. 6 shows an exemplary 8-leaf type non-circular shaped fiber according to an exemplary embodiment of the present invention, and its η value may be of about 2.8, and FIG. 7 shows an exemplary 8-leaf type non-circular shaped fiber according to an exemplary embodiment of the present invention, and its η value may be of about 3.2.

The η value of a general circular type fiber with circular cross section is about 1.0, and its sound absorption coefficient and transmission loss may be significantly reduced because its surface area is not large enough (see Comparative Example 1). Moreover, although the cross sectional shape of the non-circular shaped fiber are a six-pointed star shape, 3-bar flat type, 6-leaf type, 8-leaf type or wave type, when the η value does not satisfy about 1.5 or greater, the surface area which can generate viscosity loss of the sound energy may not be sufficient. Accordingly, the non-circular shaped fiber having the η value of about 1.5 or greater may be suitable for the sound-absorbing material of the present invention (see Comparative Examples 2 to 5).

Figure 8:
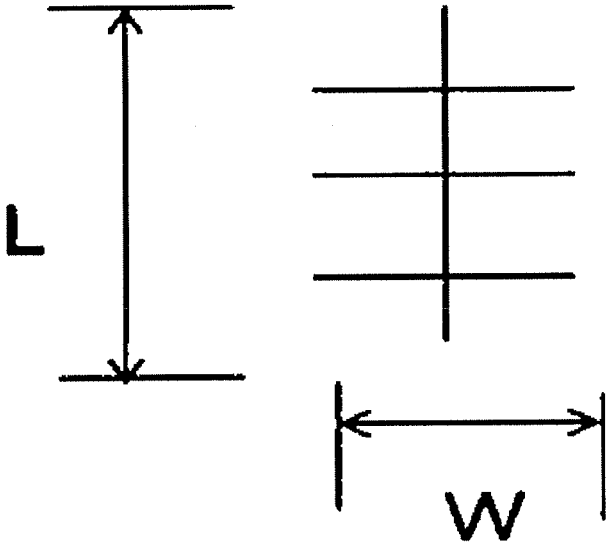
FIG. 8 shows a drawing that indicates dimensions of L and W of an exemplary 8-leaf type non-circular shaped fiber according to an exemplary embodiment of the present invention.

In particular, the non-circular shaped fiber used in the present invention may have the length/width (L/W) value of about 2 to 3. L is the abbreviation for Length which is vertical length of fiber, and W is the abbreviation for Width which is length against horizontal direction connecting between angular points. For example, FIG. 8 shows L and W values of the 8-leaf type non-circular shaped fiber. In the case of the cross section of the 8-leaf type non-circular shaped fiber, when the longer direction is referred to as vertical length, and thus the length is referred to as L, and in the 3 shorter shape, the distance between angular points may be referred to as W.

Further, the non-circular shaped fiber used in the present invention may have 6 to 8 angular points, but it is not limited to the L/W or the number of the angular point. The non-circular shaped fiber which satisfies the η value of about 1.5 or greater may be preferred.

Length of the non-circular shaped fiber may be about 35 to 65 mm. When it is less than 35 mm, it may be difficult to form and produce fiber aggregate due to wide gap between the fibers, and sound-absorbing and noise insulation performance may be reduced due to excess porosity. When it is over about 65 mm, porosity may be reduced due to too narrow gap between the fibers, thereby reducing sound absorption coefficient. Further, fineness of the non-circular shaped fiber may be about 1.0 to 7.0 De, and it may be more effective to sound-absorbing performance as fineness becomes lower. When the fineness of the non-circular shaped fiber is less than about 1.0 De, there may be a problem to control the optimum shape of the targeted cross section, and when it is greater than about 7.0 De (denier), there may be a difficulty on non-woven fiber manufacturing process and a problem of reduction of sound-absorbing performance when it is manufactured as the fiber aggregate.

The material of the non-circular shaped fiber included in the sound-absorbing material of the present invention may be polyethylene terephthalate (PET), but not particularly limited thereto. Polypropylene (PP), rayon, and any polymer that may be spun in fiber form may be used as a sound-absorbing material without limitation.

Further, the sound-absorbing material of the present invention contains binder fiber which partly binds at least a portion of the non-circular shaped fiber, or alternatively binds the non-circular shaped fiber.

The binder fiber may be any binder fiber which is generally used in the related arts when manufacturing fiber structure, and it may be used in the form of powder as well as fiber. In particular, the binder fiber may contain low melting (LM) elastomer. The elastomer generally refers to a polymer material having excellent elasticity such as rubbers, and i.e., it may refer to a polymer having a characteristic that stretches when it is pulled by external force, and then is back to the original length when the external force is removed. The LM elastomer used in the present invention may have elastic recovery modulus of about 50 to 80%. When elastic recovery modulus is less than about 50%, the fiber aggregate may be hardened, and sound-absorbing performance may be reduced due to short flexibility. When it is greater than about 80%, there may be problems that processability may be reduced when manufacturing the fiber aggregate, as well as production cost of the polymer itself may be increased.

In the related arts, a binder fiber is melted down and bound major fiber together, and then the fiber aggregate is hardened such that sound absorption coefficient is reduced because vibration generated by sound wave propagation and transmitted to matrix structure may not be fully attenuated. However, in the present invention, rebound resilience rate (for example, ASTM D 3574) of fiber structure may be increased up to about 50 to 80% by including a LM elastomer having elastic recovery modulus of about 50 to 80% in the binder fiber of the fiber aggregate. Accordingly, attenuation capability for the vibration which is ultimately transmitted inside the matrix may be improved, and sound absorption coefficient and transmission loss may be improved.

The LM elastomer may be a polyester-based polymer, a polyamide-based polymer, a polystyrene-based polymer, a polyvinylchloride-based polymer or polyurethane-based polymer, or combinations thereof.

Further, the LM elastomer may be manufactured by esterification and polymerization steps using a diacid ingredient and a diol ingredient. As used herein, "diacid ingredient" may refer to a mixture of two isomeric acids. Exemplary diacid ingredient may include, but may not be limited to, dimethyl terephthalate (DMT) and dimethyl isophthalate (DMI), or terephthalic acid(TPA) and isophthalic acid(IPA). As used herein, "diol ingredient" may refer to a mixture of two different alcohols. Exemplary diol ingredient may include, but may not be limited to, 1,4-butanediol (1,4-BD) and polytetramethyleneglycol (PTMG).

As the diacid ingredient, dimethyl terephthalate (DMT) and dimethyl isophthalate (DMI), or terephthalic acid (TPA) and isophthalic acid (IPA) may be used. Among the diacid ingredients, dimethyl terephthalate (DMT) and terephthalic acid (TPA) may form a crystal region by reacting with the diol ingredient, and dimethyl isophthalate (DMI) and isophthalic acid (IPA) may form a non-crystal region by reacting with the diol ingredient, thereby providing low melting property and elasticity.

Further, for example, a mixing ratio of dimethyl terephthalate (DMT) and dimethyl isophthalate (DMI) may be a molar ratio of about 0.65 to 0.80:about 0.2 to 0.35. A mixing ratio of terephthalic acid (TPA) and isophthalic acid (IPA) also may be a molar ratio of about 0.65 to 0.80:about 0.2 to 0.35. When the molar ratio of dimethyl isophthalate (DMI) and isophthalic acid (IPA) is less than the above described range, elastic recovery modulus may be deteriorated, and the low melting property may not be expressed. When the molar ratio of dimethyl isophthalate (DMI) and isophthalic acid (IPA) is over the above described range, physical properties may be deteriorated.

As the diol ingredient, 1,4-butanediol(1,4-BD) and polytetramethyleneglycol(PTMG) may be used, without limitation. For example, the 1,4-butanediol may form a crystal region by reacting with acid ingredient and the polytetramethyleneglycol (PTMG) may form a non-crystal region by reacting with acid ingredient, thereby providing low-melting property and elasticity.

A mixing ratio of the 1,4-butanediol (1,4-BD) and polytetramethyleneglycol (PTMG) may be a molar ratio of about 0.85 to 0.95:about 0.05 to 0.15. When the molar ratio of polytetramethyleneglycol (PTMG) is less than the above described range, elastic recovery modulus may be deteriorated, and the low-melting function may not be expressed. When the molar ratio of polytetramethyleneglycol (PTMG) is greater than the above described range, physical properties may be deteriorated. Alternatively, 1,4-butanediol (1,4-BD) may be used as a mixture with ethyleneglycol (EG) within the above described range for the diol ingredient.

Further, molecular weight of the polytetramethyleneglycol (PTMG) may be in a range of about 1500 to 2000. When the molecular weight of the polytetramethyleneglycol (PTMG) is out of the above described range, sufficient elasticity and physical properties of the LM elastomer may not be obtained for suitable use.

The diacid ingredient and the diol ingredient may be mixed at molar ratio of about 0.9 to 1.1:about 0.9 to 1.1 to be polymerized. When any one ingredient of the acid ingredient and the diol ingredient is added greater than the above mentioned range, excess amount may not be used to be polymerized and may be discarded. Accordingly, the acid ingredient and the diol ingredient may be mixed at comparable amounts.

As described above, the LM elastomer may be manufactured from the diacid ingredient, for example, di-acids of dimethyl terephthalate(DMT) and dimethyl isophthalate (DMI), and the diol ingredient, for example, 1,4-butanediol (1,4-BD) and polytetramethyleneglycol(PTMG) to have a melting point of about 150 to 180° C. and an elastic recovery modulus of about 50 to 80%.

Further, the binder fiber of the sound-absorbing material of the present invention may be a conjugated fiber which may be conjugate-spun by using the LM elastomer as one component. In particular, the binder fiber may be sheath-core type or side by side type conjugated fiber. When the sheath-core type conjugated fiber is formed, the LM elastomer may be used as a sheath ingredient, and general polyester may be used as a core ingredient. The general polyester may reduce production cost and functions as fiber supporter, and the LM elastomer provides elasticity and low melting property.

The binder fiber may be manufactured by using the LM elastomer and the general polyester at weight ratio of about 40:60 to about 60:40. When the LM elastomer is contained at weight ratio of less than about 40, elasticity and low melting property may be deteriorated, and when it is contained at weight ratio greater than about 60, production cost may be increased.

The sound-absorbing material may contain the non-circular shaped fiber of about 50 to 80 wt % based on the total weight of the sound-absorbing material and the binder fiber of 20 to 50 wt % based on the total weight of the sound-absorbing material. When the content of the non-circular shaped fiber is less than about 50 wt %, it may be difficult to embody the optimal sound-absorbing and noise insulation performances due to reduced fiber surface area, but when the content of the non-circular shaped fiber is greater than about 80 wt %, the content of the binder fiber may be reduced to less than about 20 wt %, relatively, and it may be difficult to maintain enough binding strength between the fiber. Thus, it may be difficult to form the sound-absorbing material to a certain shape and the vibration, which is generated from sound wave propagation and transmitted to the matrix structure, is not fully attenuated because the matrix structure is not strong, such that low frequency sound absorption coefficient may be reduced. As the content of the binder fiber is increased to about 20 to 50 wt % based on the total weight of the sound-absorbing material, rebound elasticity modulus (for example, ASTM D 3574) may increase up to about 50 to 80%.

The fiber structure with polymorphic cross section having improved sound-absorbing performance may be manufactured by a method for manufacturing a sound-absorbing material. The method may comprise forming fiber aggregate in the nonwoven fabric fabric form, and the fiber aggregate may comprise: a non-circular shaped fiber satisfying the following Formula 1; and a binder fiber which may partly bind at least a portion of the non-circular shaped fiber. Alternatively, the binder fiber may bind the non-circular shaped fiber, or portions of a plurality of the non-circular shaped fibers.

$$1.5 \leq \frac{P}{\sqrt{4 \times \pi \times A}} \qquad \text{Formula 1}$$

In Formula 1, A refers to a fiber cross sectional area ($\mu m^2$), and P refers to a circumference length of fiber cross section ($\mu m$).

The sound-absorbing material may be manufactured by forming the fiber aggregate containing the non-circular shaped fiber and the binder fiber in the non-woven form having a certain surface density by general manufacturing processes for a fiber structure sound-absorbing material such as needle punching process or thermal adhesion process and the like. Hereinafter, detailed description about the above-described non-circular shaped fiber and the binder fiber, which are identically applied to the method for manufacturing the sound-absorbing material of the present invention will be omitted.

EXAMPLES

The following examples illustrate the invention and are not intended to limit the same.

Example 1

Polyester-based 8-leaf type (FIG. 4, η=2.5) non-circular shaped fiber (6.5 De, of about 61 mm, strength of about 5.8 g/D, elongation rate of about 40%, crimp number of about 14.2/inch) and sheath-core type conjugated fiber containing polyester-based LM elastomer as binder fiber were mixed at weight ratio of about 8:2, the mixture was physically broken down through needle punching process after controlling weight constantly, and then non-woven type fiber aggregate having thickness of about 20 mm and surface density of about 1600 g/m$^2$ was manufactured through a general thermal adhesion process. Rebound resilience of the manufactured sound-absorbing material was of about 55%.

The sheath-core type conjugated fiber containing polyester-based LM elastomer as binder fiber contained polyester-based LM elastomer as a sheath ingredient, and the polyester-based LM elastomer used a mixture of terephthalic acid of about 75 mole % and isophthalic acid of about 25 mole % as an acid ingredient and a mixture of polytetramethyleneglycol of about 8.0 mole % and 1,4-butanediol of about 92.0 mole % as a diol ingredient, and manufactured by mixing and polymerizing the acid ingredient and the diol ingredient at molar ratio of about 1:1. The LM elastomer manufactured as mentioned above has melting point of about 50° C., intrinsic viscosity of about 1.4 and elastic recovery modulus of about 80%. As the core ingredient, polyethylene terephthalate(PET) having melting point of about 260° C. and intrinsic viscosity of about 0.65 was used, and conjugated fiber having fineness of about 6 D, strength of about 3.0 g/D, elongation rate of about 80%, crimp number of about 12/inch and fiber length of about 64 mm was manufactured by spinning using a conjugate spinning nozzle, which can conjugate spin the polyester-based LM elastomer and the general PET at spinning temperature of about 275° C. and winding speed of about 1,000 mm/min, elongated by about 3.3 folds at about 77° C., and finally heated at about 140° C.

Example 2

The procedure of Example 1 was repeated except for manufacturing non-woven type fiber structure having thickness of about 20 mm, surface density of about 1200 g/m$^2$.

Example 3

The procedure of Example 1 was repeated except for manufacturing a sound-absorbing material using six-pointed star shaped (FIG. 1, η=1.51) non-circular shaped fiber.

Example 4

The procedure of Example 1 was repeated except for manufacturing a sound-absorbing material using 3-bar flat type (FIG. 2, η=1.60) non-circular shaped fiber.

Example 5

The procedure of Example 1 was repeated except for manufacturing a sound-absorbing material using 6-leaf type (FIG. 3, η=1.93) non-circular shaped fiber.

Example 6

The procedure of Example 1 was repeated except for manufacturing a sound-absorbing material using wave type (FIG. 5, η=2.55) non-circular shaped fiber.

Example 7

The procedure of Example 1 was repeated except for manufacturing a sound-absorbing material using 8-leaf type (FIG. 6, η=2.8) non-circular shaped fiber non-circular shaped fiber.

Example 8

The procedure of Example 1 was repeated except for manufacturing a sound-absorbing material using 8-leaf type (FIG. 7, η=3.2) non-circular shaped fiber non-circular shaped fiber.

Example 9

The procedure of Example 1 was repeated except for manufacturing a sound-absorbing material using low melting PET fiber as binder fiber. Rebound resilience of the manufactured sound-absorbing material was about 30%.

Comparative Example 1

The procedure of Example 1 was repeated except for manufacturing a sound-absorbing material using circular (η=1.0) shaped fiber.

Comparative Example 2

The procedure of Example 1 was repeated except for manufacturing a sound-absorbing material using five-pointed star shape (η=1.30) non-circular shaped fiber.

Comparative Example 3

The procedure of Example 1 was repeated except for manufacturing a sound-absorbing material using wave type (η=1.42) non-circular shaped fiber.

Comparative Example 4

The procedure of Example 1 was repeated except for manufacturing a sound-absorbing material using Y type (η=1.26) non-circular shaped fiber.

Comparative Example 5

The procedure of Example 1 was repeated except for manufacturing a sound-absorbing material using six-pointed star shape (η=1.41) non-circular shaped fiber.

Test Example

In order to evaluate sound-absorbing and noise insulation performances of the sound-absorbing materials manufactured according to Examples 1 to 9 and Comparative Examples 1 to 5, the materials were tested as the following measuring methods, and the results were shown in Tables 1 and 2.

1. Sound Absorption Coefficient

In order to measure sound absorption coefficient, 3 specimens applicable to ISO R 354, Alpha Cabin method were manufactured, respectively, sound-absorbing coefficients were measured and the mean of the measured sound-absorbing coefficients were shown in Table 1.

2. Transmission Loss

In order to measure noise insulation effect, 3 specimens applicable to a transmission loss coefficient evaluating device (APAMAT-II. MANUFACTURER: Autoneum) were manufactured, respectively, insertion loss was measured, and the mean value of the measured insertion loss was shown in Table 2.

3. Elastic Recovery Modulus

A dumbbell shape specimen having thickness of about 2 mm and length of about 10 cm was elongated about 200% at a rate of about 200%/min using UTM (universal testing machine), MANUFACTURER: Instron), waited for about 5 sec, and the elongated length after recovered at the same rate was measured, and then elastic recovery modulus was calculated by the following Formula.

$$\text{Elasticity Recovery Rate}(\%) = \frac{20-(L-10)}{20} \times 100$$

($L$: Elongated Length)

4. Rebound Resilience Rate (Ball Rebound)

After dropping a metal ball from a certain height to a test specimen, the height of the rebound ball was measured (JIS K-6301, unit: %). Test specimen was made into a square having a side length of 50 mm or greater and thickness of about 50 mm or greater, and a steel ball having weight of about 16 g and diameter of about 16 mm was dropped from a height of about 500 mm to the test specimen, and then the maximum rebound height was measured. Then, for each 3 test specimens, the rebound value was measured at least 3 times in a raw within about 1 min, and the median value was used as rebound resilience rate (%).

TABLE 1

| | Sound absorption coefficient per frequency (Hz) | | | |
|---|---|---|---|---|
| | 1000 Hz | 2000 Hz | 3150 Hz | 5000 Hz |
| Example 1 | 0.67 | 0.75 | 0.84 | 0.96 |
| Example 2 | 0.54 | 0.63 | 0.77 | 0.85 |
| Example 3 | 0.62 | 0.67 | 0.78 | 0.88 |
| Example 4 | 0.59 | 0.71 | 0.81 | 0.90 |
| Example 5 | 0.62 | 0.69 | 0.80 | 0.90 |
| Example 6 | 0.66 | 0.77 | 0.85 | 0.97 |
| Example 7 | 0.67 | 0.78 | 0.89 | 0.99 |
| Example 8 | 0.68 | 0.79 | 0.91 | 1.00 |
| Example 9 | 0.50 | 0.70 | 0.79 | 0.89 |
| Comparative Example 1 | 0.51 | 0.61 | 0.74 | 0.83 |
| Comparative Example 2 | 0.57 | 0.65 | 0.75 | 0.86 |
| Comparative Example 3 | 0.57 | 0.62 | 0.76 | 0.86 |
| Comparative Example 4 | 0.56 | 0.64 | 0.75 | 0.85 |
| Comparative Example 5 | 0.61 | 0.65 | 0.75 | 0.86 |

TABLE 2

| | Transmission loss (dB) per frequency (Hz) | | | |
|---|---|---|---|---|
| | 1000 Hz | 2000 Hz | 3150 Hz | 5000 Hz |
| Example 1 | 25 | 27 | 35 | 43 |
| Example 2 | 23 | 24 | 32 | 41 |
| Example 3 | 22 | 25 | 32 | 40 |
| Example 4 | 24 | 25 | 33 | 41 |
| Example 5 | 24 | 26 | 33 | 41 |
| Example 6 | 25 | 27 | 35 | 44 |
| Example 7 | 26 | 28 | 36 | 45 |
| Example 8 | 27 | 30 | 38 | 47 |
| Example 9 | 21 | 24 | 31 | 40 |
| Comparative Example 1 | 22 | 23 | 31 | 40 |
| Comparative Example 2 | 21 | 24 | 31 | 40 |
| Comparative Example 3 | 22 | 24 | 32 | 41 |
| Comparative Example 4 | 21 | 24 | 31 | 40 |
| Comparative Example 5 | 22 | 24 | 32 | 40 |

As shown in Tables 1 and 2, as comparing the results of measuring sound-absorbing and noise insulation performances in Examples 1 to 9 and Comparative Examples 1 to 5, it was found that sound-absorbing and noise insulation performances of the fiber aggregate were improved as the fiber surface areas were increased.

For example, as comparing the result of measuring performances of Example 2 and Comparative Example 1, it was found that the sound-absorbing material using the non-circular shaped fiber of the present invention had better sound-absorbing and noise insulation performances than the fiber sound-absorbing material using fiber with circular cross section generally used, despite the reduced surface density of the fiber aggregate, and therefore, light-weight design thereof is possible by using a small amount of fiber.

It is found that Examples 1 to 9 satisfying the $\eta$ value of about 1.5 or greater had improved sound absorption coefficient and transmission loss than Comparative Examples 1 to 5 having the $\eta$ value of less than about 1.5. It was found that Comparative Example 5 having the value of less than about 1.5 also had low effect on sound absorption coefficient and transmission loss due to small surface area, although six-pointed star shape non-circular shaped fiber was used.

Further, as comparing the results of measuring performances of Example 9 using the low melting PET fiber as binder fiber and Examples 1 to 8 using the low melting elastomer, it was found that flexible structure having rebound elasticity rate of about 55% was obtained by using low melting elastomer as binder fiber, and sound-absorbing performance was improved by improved attenuation capability of the vibration transmitted to the matrix structure.

What is claimed is:

1. A method for manufacturing a sound-absorbing material, comprising forming a fiber aggregate in a nonwoven fabric form, wherein the fiber aggregate comprises:

a non-circular shaped fiber satisfying the following Formula 1; and a binder fiber that partly binds at least a portion of the non-circular shaped fiber, wherein the non-circular shaped fiber is about 50 to 80 wt % based on the total weight of the sound-absorbing material and the binder fiber is about 20 to 50 wt % based on the total weight of the sound-absorbing material, $$1.5 \leq \frac{P}{\sqrt{4 \times \pi \times A}} \quad \text{Formula 1}$$

wherein A is a fiber cross sectional area ($\mu m^2$), P is a circumference length of fiber cross section (μm).

2. A method for manufacturing a sound-absorbing material, comprising forming a fiber aggregate in a nonwoven fabric form, wherein the fiber aggregate comprises:

a non-circular shaped fiber satisfying the following Formula 1; and a binder fiber that binds the non-circular shaped fiber, wherein the non-circular shaped fiber is about 50 to 80 wt % based on the total weight of the sound-absorbing material and the binder fiber is about 20 to 50 wt % based on the total weight of the sound-absorbing material, $$1.5 \leq \frac{P}{\sqrt{4 \times \pi \times A}} \quad \text{Formula 1}$$

wherein A is a fiber cross sectional area ($\mu m^2$), P is a circumference length of fiber cross section (μm).

3. The method for manufacturing a sound-absorbing material of claim 1, wherein the sound-absorbing material is manufactured by using the non-circular shaped fiber satisfying the value of the Formula 1 of about 2.6 or greater.

4. The method for manufacturing a sound-absorbing material of claim 1, wherein a cross sectional shape of the non-circular shaped fiber is at least one selected from the group consisting of six-pointed star shape, 3-bar flat type, 6-leaf type, 8-leaf type and wave type.

5. The method for manufacturing a sound-absorbing material of claim 1, wherein the non-circular shaped fiber is about 35 to 65 mm in length.

6. The method for manufacturing a sound-absorbing material of claim 1, wherein the binder fiber comprises a low melting (LM) elastomer having elastic recovery modulus of about 50 to 80%.

7. The method for manufacturing a sound-absorbing material of claim 6, wherein the binder fiber is a conjugated fiber which is conjugate-spun by using the LM elastomer as one component.

8. The method for manufacturing a sound-absorbing material of claim 6, wherein the LM elastomer is at least one selected from the group consisting of a polyester-based polymer, a polyamide-based polymer, a polystyrene-based polymer, a polyvinylchloride-based polymer and a polyurethane-based polymer.

9. The method for manufacturing a sound-absorbing material of claim 6, wherein the LM elastomer is manufactured by esterification and polymerization steps using dimethyl terephthalate (DMT) and dimethyl isophthalate(DMI), or terephthalic acid (TPA) and isophthalic acid (IPA) as an acid ingredient, and 1,4-butanediol (1,4-BD) and polytetramethyleneglycol(PTMG) as a diol ingredient.

10. The method for manufacturing a sound-absorbing material of claim 1, wherein the non-circular shaped fiber satisfies the value of the Formula 1 of about 3.0 or greater.

11. A sound-absorbing material, comprising:

a non-circular shaped fiber satisfying the following Formula 1; and a binder fiber that partly binds at least a portion of the non-circular shaped fiber, wherein the non-circular shaped fiber is about 50 to 80 wt % based on the total weight of the sound-absorbing material and the binder fiber is about 20 to 50 wt % based on the total weight of the sound-absorbing material, $$1.5 \leq \frac{P}{\sqrt{4 \times \pi \times A}} \quad \text{Formula 1}$$

wherein A is a fiber cross sectional area ($\mu m^2$), P is a circumference length of fiber cross section (μm).

12. A sound-absorbing material, comprising:

a non-circular shaped fiber satisfying the following Formula 1; and a binder fiber that binds the non-circular shaped fiber, wherein the non-circular shaped fiber is about 50 to 80 wt % based on the total weight of the sound-absorbing material and the binder fiber is about 20 to 50 wt % based on the total weight of the sound-absorbing material, $$1.5 \leq \frac{P}{\sqrt{4 \times \pi \times A}}$$

wherein A is a fiber cross sectional area ($\mu m^2$), P is a circumference length of fiber cross section (μm).

13. The sound-absorbing material of claim 11, wherein the non-circular shaped fiber satisfies the value of the Formula 1 of about 2.6 or greater.

14. The sound-absorbing material of claim 11, wherein a cross sectional shape of the non-circular shaped fiber is at least one selected from the group consisting of six-pointed star shape, 3-bar flat type, 6-leaf type, 8-leaf type and wave type.

15. The sound-absorbing material of claim 11, wherein the non-circular shaped fiber is about 35 to 65 mm in length.

16. The sound-absorbing material of claim 11, wherein the non-circular shaped fiber is about 1.0 to 7.0 De in fineness.

17. The sound-absorbing material of claim 11, wherein the binder fiber comprises a low melting (LM) elastomer having elastic recovery modulus of 50 to 80%.

18. The sound-absorbing material of claim 17, wherein the binder fiber is conjugated fiber which is conjugate-spun by using the LM elastomer as one component.

19. The sound-absorbing material of claim 17, wherein the LM elastomer is at least one selected from the group consisting of a polyester-based polymer, a polyamide-based polymer, a polystyrene-based polymer, a polyvinylchloride-based polymer and a polyurethane-based polymer.

20. The sound-absorbing material of claim 11, wherein the non-circular shaped fiber satisfies the value of the Formula 1 of about 3.0 or greater.

21. A vehicle that comprises a sound-absorbing material of claim 11.

* * * * *